US007275392B2

(12) United States Patent
Perrine et al.

(10) Patent No.: US 7,275,392 B2
(45) Date of Patent: Oct. 2, 2007

(54) INTERNAL CAGE TUBE BAG

(75) Inventors: Glenn D. Perrine, Lewisburg, OH (US); Douglas E. LeConey, Clayton, OH (US)

(73) Assignee: Flow Dry Technology, Inc., Brookville, OH (US)

( * ) Notice: Subject to any disclaimer, the term of this patent is extended or adjusted under 35 U.S.C. 154(b) by 162 days.

(21) Appl. No.: 10/555,441

(22) PCT Filed: May 18, 2004

(86) PCT No.: PCT/US2004/015426

§ 371 (c)(1),
(2), (4) Date: Nov. 3, 2005

(87) PCT Pub. No.: WO2004/103829

PCT Pub. Date: Dec. 2, 2004

(65) Prior Publication Data

US 2007/0051128 A1 Mar. 8, 2007

Related U.S. Application Data

(60) Provisional application No. 60/471,692, filed on May 19, 2003.

(51) Int. Cl.
*F25B 43/04* (2006.01)

(52) U.S. Cl. ..... 62/475; 62/508

(58) Field of Classification Search ..... 62/271, 62/474, 475, 508; 96/117.5, 135; 210/287
See application file for complete search history.

(56) References Cited

U.S. PATENT DOCUMENTS

| | | | | |
|---|---|---|---|---|
| 5,149,453 | A | 9/1992 | Parekh | |
| 5,228,315 | A | 7/1993 | Nagasaka et al. | |
| 5,666,791 | A | 9/1997 | Burk | |
| 5,813,249 | A | 9/1998 | Matsuo et al. | |
| 5,868,002 | A | 2/1999 | Matsubayashi | |
| 6,170,287 | B1 | 1/2001 | Leitch et al. | |
| 6,360,560 | B1 | 3/2002 | Whitlow et al. | |
| 6,395,074 | B1 * | 5/2002 | Mastromatteo | 96/135 |
| 6,474,098 | B2 * | 11/2002 | Perrine et al. | 62/475 |
| 6,763,679 | B1 * | 7/2004 | Leitch et al. | 62/474 |

* cited by examiner

*Primary Examiner*—Melvin Jones
(74) *Attorney, Agent, or Firm*—Wegman, Hessler & Vanderburg

(57) ABSTRACT

A desiccant package for insertion into an integrated condenser dryer chamber of an air conditioning unit. The desiccant package includes an internal cage component which is enclosed inside a porous desiccant-containing bag. The internal cage component comprises an enlarged diameter base unit and sealing section to seal and support the desiccant package inside the dryer chamber. The desiccant package can be inserted into the condenser dryer at initial assembly of the air conditioning unit or as a replacement item when the original desiccant is fully saturated.

17 Claims, 3 Drawing Sheets

INTERNAL CAGE TUBE BAG

CROSS-REFERENCE TO RELATED APPLICATIONS

This application claims the priority filing benefit of International PCT Application PCT/US2004/015426 filed May 18, 2004, and published under PCT 21(2) in the English language and Provisional patent application Ser. No. 60/471,692 filed May 19, 2003;

BACKGROUND OF THE INVENTION

1. Field of the Invention

The present invention relates to a desiccant-containing package for use in an integrated condenser dryer, and more particularly relates to an improved desiccant-containing package for insertion into an integrated condenser dryer chamber of a vehicle or mobile air conditioning system.

2. Description of the Prior Art

Mobile air conditioning systems typically include an integrated condenser dryer chamber or receiver chamber that serves as an accumulator reservoir for refrigerant. The dryer chamber provides a convenient location for a container or package of desiccant material, usually a bag or pouch of mesh material, which absorbs water vapor from the liquid refrigerant reservoir. The desiccant bag performs better when the bag is suspended within the chamber, rather than resting free on the bottom of the chamber. In order to suspend the desiccant bag in the dryer chamber, some kind of fixturing or added parts must be incorporated within the dryer chamber itself or else the desiccant bag may fall to the bottom of the canister tube, making the bag difficult to remove. In systems where the desiccant bag rests on the bottom of the canister tube, a separate filter is normally required because it would not be possible to force all the refrigerant fluid through the entire surface of the desiccant bag.

Desiccant-containing packages are typically employed in relatively small diameter receivers that are juxtaposed along one of the condenser headers in an integrated condenser/receiver for an automotive air-conditioning system or the like. These integrated condenser/receiver structures eliminate the need for separate tubing to connect the condenser with the receiver and have become popular due to their reduced spatial requirements as compared with earlier designs. For instance, the overall dimensions of one integrated condenser/receiver proposed in U.S. Pat. No. 5,813,249 are from about 300 mm-400 mm in height and about 300 mm-600 mm in width.

In the integrated condenser/receiver design proposed in the '249 patent, the axes of the receiver canister and the associated header lie parallel to that of the canister attached to, and contiguous with, the header. The desiccant-containing package positioned in the receiver dries refrigerant fluid (and the oil and moisture entrained therein) before the dried refrigerant enters a supercooler unit formed integrally with the condenser. Ultimately, when the desiccant material becomes saturated with contaminants, the desiccant material is spent and must be replaced.

Due to the compactness of the receiver chamber, it can be difficult to insert, position and remove desiccant bags or cartridges from the receivers of known integrated condenser/receivers. In particular, many known receiver designs require the removal and disposal of significant extraneous materials associated with the spent desiccant bags, thereby increasing the expense incurred during the replacement of the spent desiccant bags.

For example, desiccant package designs are known to include an insert design made through plastic injection molding, including various features to accomplish removal, filtering, and proper positioning of the desiccant within the canister tube. These designs can be quite expensive, both to produce and tool, and do not allow flexibility for different length canisters and/or different desiccant volumes.

Other known desiccant package designs incorporate a disk-shaped filter apparatus into a cross sectional area of the integrated condenser tub. These designs are limited because the filtration area of the disk-shaped filter is virtually equal to the diameter of the integrated condenser tube. As condenser tubes are made smaller and smaller to accommodate smaller and smaller air conditioning units, total filtration area is further diminished. Such a limited filter surface area results in unsatisfactory filtration performance. As a result, it is desirable to efficiently optimize the effective surface area of condenser tube filters.

U.S. Pat. No. 5,666,791 proposes an insert for a vehicle air conditioner. The insert is composed of two parts. One part contains a filter screen. The other part is an extension part bridging the distance from the filter screen to a detachable cover of the receiver.

According to the '791 patent, the part which contains the filter screen and which requires higher manufacturing expenditures may be standardized for several sizes of condensers so that it can be produced in the same shape in large piece numbers. Depending on the size of the receiver, the part containing the filter screen is supplemented by an extension part which has a relatively simple shape and can therefore be produced at a reasonable price in different lengths by means of a modular-construction tool. In addition, the '791 patent teaches that the construction reduces the amount of disposable waste generated when the desiccant material is spent because it will be sufficient to exchange and dispose of the part with the filter screen.

Nevertheless, the insert as a whole is likely to be relatively complex and expensive to produce. In one embodiment taught in U.S. Pat. No. 5,666,791, the container is provided on the inside with a supporting screen. The container, which is made of plastic, is molded around this supporting screen. The supporting screen may consist of plastic or of a special steel, the former having the advantage of being recyclable. In addition, it appears that a filter screen comprising a filter nonwoven material or a needle felt is assembled into the container. This mode of manufacture involves multiple component parts and several manufacturing steps, the combination of which likely increases the cost of manufacture.

U.S. Pat. No. 6,170,287 proposes that a tube of desiccant material be installed and located within a receiver canister by a stand-off component comprised of a tight-fitting, notched, disk-shaped base and a narrow central post which is comparable in length to the height of the inlet above the lower end cap. The tight fit allows the tube to be inserted up into the canister, well away from the bottom of the canister and free of heat damage as an end cap of the canister is attached.

U.S. Pat. No. 6,360,560 proposes a condenser with an integral receiver dryer. The receiver dryer includes a dryer capsule for removing moisture from the refrigerant fluid. One drawback to the dryer capsule proposed in the reference is its relative complexity and likely expense of manufacture.

The dryer capsule proposed in U.S. Pat. No. 6,360,560 is generally cylindrical in shape and includes a base, a housing extending axially from the base and a cap closing an end of the housing. The base is disposed adjacent a seat wall to create a seal and prevent fluid from passing therebetween. The housing has a plurality of apertures extending therethrough and a filter covering the apertures. The dryer capsule includes a quantity of dryer material such as desiccant disposed within the housing. The cap has a loop with an aperture extending therethrough to allow a tool to engage the loop to remove the dryer capsule from the receiver dryer. The loop also acts as a spring to hold the base of the dryer capsule against the seat wall when an end closure is in place over an open end of the receiver dryer.

The end closure proposed in U.S. Pat. No. 6,360,560 has a head extending radially and a threaded shaft extending axially. The end closure also includes a seal disposed about the threaded shaft and adjacent the head. The threaded shaft engages the threaded open end such that the seal engages the side and the head overlaps the side bounding the open end.

It is known to place a fluorescent tracer dye wafer or the like in the desiccant package so that leaks in the refrigeration system can be readily detected by use of an ultraviolet light source. See for instance U.S. Pat. Nos. 5,149,453 and 5,440,910.

Accordingly, it would be desirable to have a desiccant package system that meets packaging and performance requirements in a more cost effective way. Therefore, there remains a need in the art for improvements to desiccant packages which simplify the manufacture, installation and removal of the packages and which minimizes the extraneous material which must be disposed of upon discarding the spent desiccant bags.

SUMMARY OF THE INVENTION

It is an object of the present invention to provide a simple and cost effective desiccant package that is easy to install and remove from an integrated condenser dryer chamber of a mobile air conditioning system. As described herein, the present invention provides an Internal Cage Tube Bag (ICTB) design that is relatively easy to manufacture and that satisfies packaging and performance requirements while holding the desiccant material tightly inside the container.

The present ICTB design, which utilizes the desiccant bag itself as the package for the desiccant material, is an economical method of containing the desiccant material both before and after assembly into the condenser dryer. The ICTB design utilizes a simple internal cage component that is inserted into the desiccant bag. This design is advantageous because the internal cage component may be manufactured very inexpensively, for example molded from plastic material, and because the component may be formed to varying lengths to adapt to the customer requirements for the length of the condenser/dryer chamber.

Moreover, the working or sealing diameter of the internal cage component can be adjusted to utilize its major diameter plus the thickness of the bag material to create a tight seal against the inner diameter of the integrated condenser dryer chamber. Other methods of sealing are expensive and can be dislodged out of position.

It is another object of the invention to position the desiccant package such that the bag area on the inlet side of the condenser dryer chamber is much greater than the diameter of the integrated condenser tube, thereby greatly improving filtration performance. Since the fluid or gas flow must flow into the bag at one end and out of the bag at the other end, the invention provides two surface areas for filtration to occur. Thus, the invention provides a "double" filtration system, providing enhanced filtration capacity over other prior art devices.

In one aspect of the invention, a center stabilizer section of the internal cage component can be adjusted to fit the length of the desiccant bag. In other aspects of the invention, the center stabilizer section may protrude or extend out either or both ends of the bag to provide a means to grip and remove the entire ICTB when the Air Conditioning system of the automobile is serviced. If the stabilizer section is made to protrude from the desiccant bag, well-known ultrasonic sealing methods can be employed to seal the bag around the protruding stabilizer section in order to ensure that the desiccant beads cannot escape the bag. In still other aspects of the invention, it is contemplated that an internal cage component can be provided without the center stabilizer section, whereby the base unit provides the required sealing and support structure inside the receiver chamber.

Accordingly, it is another object of the present invention to configure the internal cage component in shape and size so that the sealing component can be positioned properly between the inlet and outlet tubes of the integrated condenser dryer. Proper positioning of the sealing component between the inlet and outlet tubes ensures that the inlet and outlet tubes will not be blocked by the internal cage component and that no (unfiltered) bypass of fluid outside the desiccant package is allowed.

It is still another object of the invention to provide a desiccant package that can be inserted into the condenser dryer both in initial assembly of the air conditioning unit and also as a replacement item when the original desiccant is fully saturated.

It is yet another object of the invention to provide a sealing section that can be inexpensively constructed of nylon, temperature resistant plastic, stainless steel or aluminum, so that the sealing section can hold its dimensions throughout any heat cycle testing that could cause other materials to shrink and lose their sealing capability.

DETAILED DESCRIPTION OF THE PREFERRED EMBODIMENT

Figures 1A, 1B:
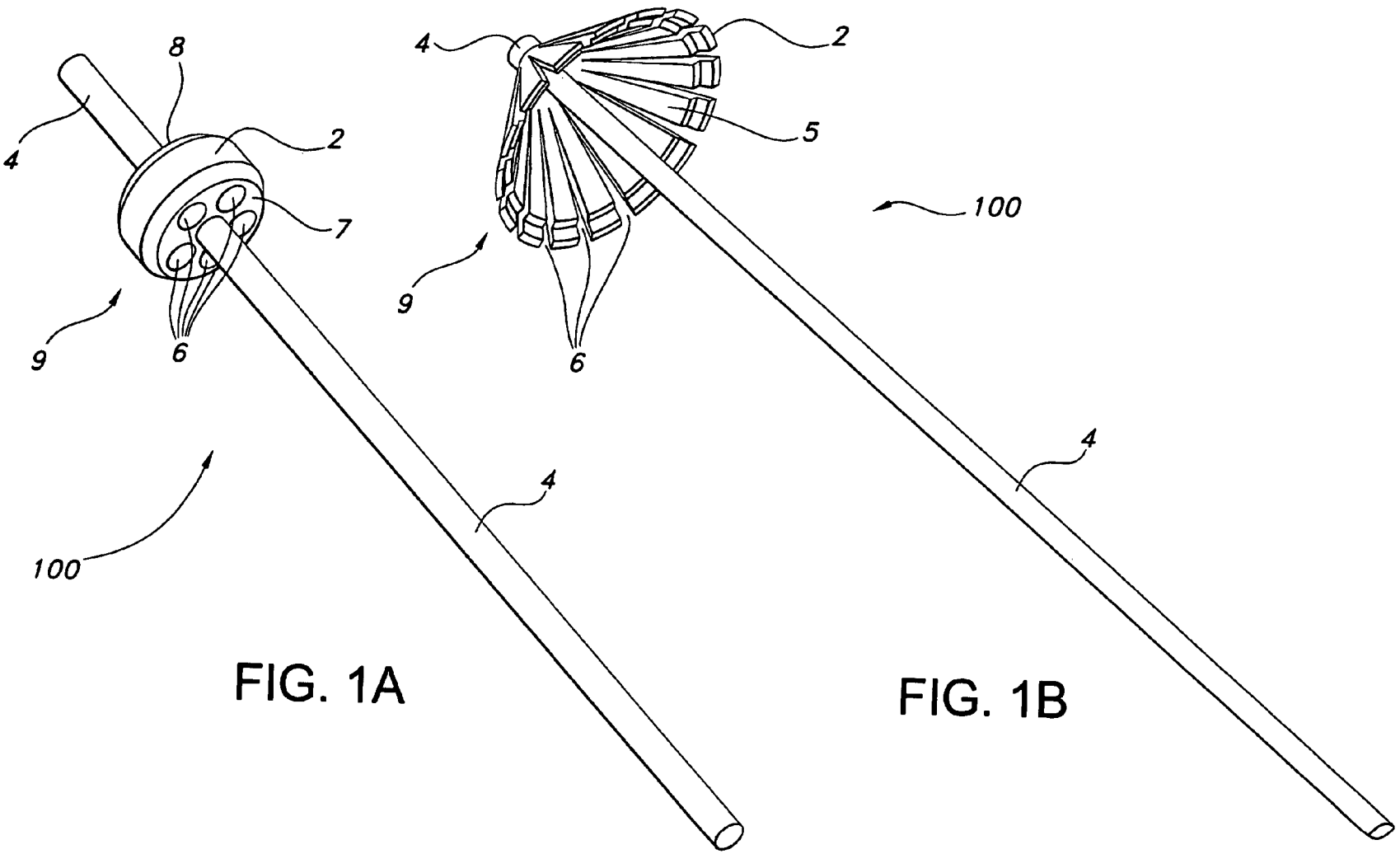
FIG. 1A is an isometric view of an internal cage component in accordance with an embodiment of the invention.
FIG. 1B is an isometric view of an internal cage component in accordance with an alternative embodiment of the invention.

With reference now to the drawings, wherein like numerals represent like parts throughout, FIG. 1A shows an internal cage component 100 in accordance with an embodiment of the present invention. The cage component 100 comprises a base unit 9 and a center stabilizer section 4 wherein the base unit 9 further comprises a sealing section 2. According to the embodiment of FIG. 1A, the center stabilizer section 4 extends axially from a pair of side portions 7, 8 of the base unit 9 (side portion 8 not visible in FIG. 1A). The side portions 7, 8 define a passable section with a plurality of passages 6, each passage 6 preferably oriented in a circular array positioned around the outside diameter of the center stabilizer section 4 as best shown in FIG. 1A. Each passage 6 passes through the entire length of the base unit 9, thereby providing a passable section through the base unit 9 wherein a plurality of uninterrupted fluid passageways are provided between the associated side portions 7, 8.

Turning to FIG. 1B, another embodiment of an internal cage component is illustrated. In this embodiment, the base unit 9 is configured into a conical shape wherein a series of cut-out wedges 5 extend from the apex near the stabilizer section 4 to define a sealing section 2 proximate the ends of the cut-out wedges. The cut-out wedges 5 are spaced apart so as to leave a series of gaps or passages 6 between each of the several cut-out wedges to provide a passable section through a length of the conical base unit 9. Unlike the generally rigid construction of the sealing section 2 of the base unit 9 of FIG. 1A, the generally conical shape of the base unit 9 of FIG. 1B allows the sealing section 2 to flex inward or compress toward the stabilizer section 4 if sufficient outer forces are applied to the outside diameter of the sealing section 2. As explained in more detail below, such flexibility allows the conical base unit 9 to be more flexible to variations in the receiver chamber diameters that it will fit. Moreover, due to the flexibility of the general conical shape of the base unit, it has been found that an internal cage component constructed in accordance with the embodiment of FIG. 1B is easier to install in an associated receiver chamber.

Referring to FIGS. 1A, 1B, it is understood that the base unit 9 and the center stabilizer section 4 may, for example, be molded out of any acceptable plastic that is structurally sound and compatible with refrigerants, such as polypropylene, nylon, or high temperature plastic. Metals including aluminum and stainless steel can also be mentioned. Polypropylene material is presently preferred, although it may be required that the diameter sealing section 2 or base unit 9 be made of aluminum or some other heat resistant material. It is not critical to the preferred embodiments of the present invention whether the base unit 9 and stabilizer section 4 are manufactured together as one piece or whether the components are manufactured as separate pieces. Skilled artisans will appreciate that many different molding or machining methods may be employed to manufacture the internal cage component 100 as required. For example, if the components are manufactured separately, it is understood that the base unit 9 could be simply press fit onto the stabilizer section 4. Alternatively, it is contemplated that standard detent locks could be used to attach the base unit 9 to the stabilizer section 4 as required.

Figure 2:
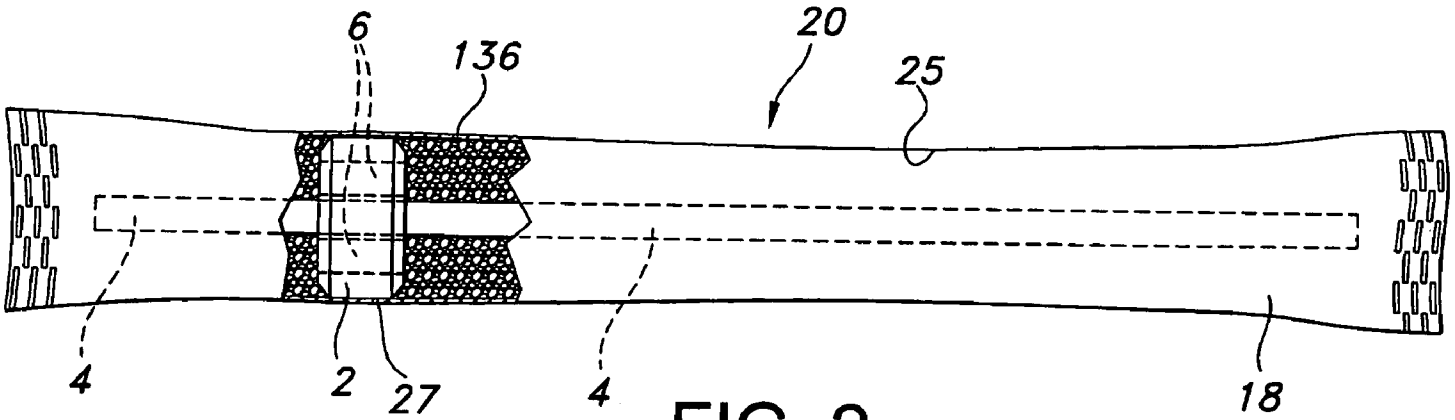
FIG. 2 is a side view of a fully assembled desiccant-containing package in accordance with an embodiment of the invention.

Turning next to FIG. 2, there is shown a fully assembled desiccant package 20 in accordance with an embodiment of the invention, wherein the sealing section 2 of the base unit 9 and the center stabilizer section 4 are fully enclosed within a desiccant-containing bag 18. The desiccant bag 18 is preferably formed from a tube of porous polyester felt material, however, it is understood that many other acceptable materials may be used, for example PBN Nylon, Nylon mesh, or other suitable filter media. During the bag manufacturing process (not shown), one end of the polyester felt tube is sealed, preferably by tucking a portion of the tube side wall (not shown) and flattening the end portion under conditions which cause the polyester fibers to fuse together and seal the end of the bag. Once the polyester felt pouch is formed, the internal cage component 100 and desiccant material 136 may be inserted into the bag, and then the end of the bag may be sealed. The ends of the desiccant bag 18 are preferably sealed by means of ultrasonic welding as understood by those skilled in the art. The desiccant material 136 may be of any type and quantity reasonably required to meet system dehydration requirements.

Figure 3:
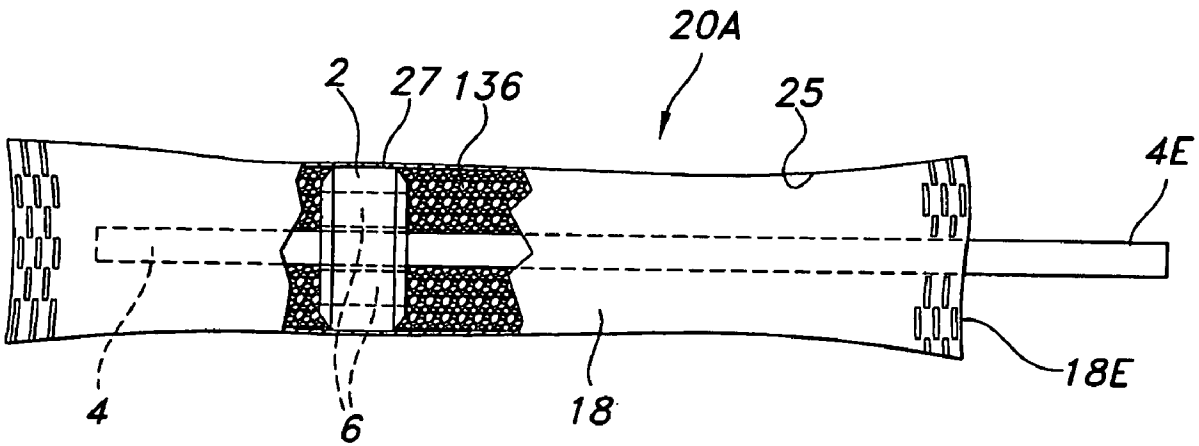
FIG. 3 is a side view of a fully assembled desiccant-containing package in accordance with an alternative embodiment of the invention.

Turning now to an alternative construction as shown in FIG. 3, it is apparent that an end 4E of the center stabilizer section protrudes beyond an end 18E of the porous desiccant bag 18. In the embodiment of FIG. 3, it is contemplated that well-known ultrasonic sealing methods can be employed to seal the end 18E of the desiccant bag around the protruding stabilizer section 4E to ensure that desiccant beads cannot escape the bag. By allowing the center stabilizer section to extend beyond an end of the porous desiccant bag, the protruding stabilizer section 4E provides convenient means for gripping the entire desiccant package 20A during installation and removal from the integrated dryer chamber.

In view of the embodiments shown in FIGS. 2 and 3, it is apparent that the overall length of the center stabilizer section 4 can vary depending on the length of the desiccant bag 18, or it may be longer than the bag, be sealed around, and protrude from the end of the bag to allow for gripping and easy removal from the integrated condenser dryer. In this way, the length and exact features of the desiccant bag can be adapted to the individual condenser dryer model in which it will be inserted. The length of the entire desiccant package is determined first by the length of the desired mating condenser dryer tube, although it is contemplated that the desiccant bag 18 itself can be constructed to a shorter length (see FIG. 3). The length of the chamber for the desiccant package can then be determined by the volume of desiccant required of the particular system. Additionally, it can be seen that the outer diameter of the sealing section 2 presses snugly against the interior wall 25 of the bag 18 to form a seal with the wall.

Figure 4:
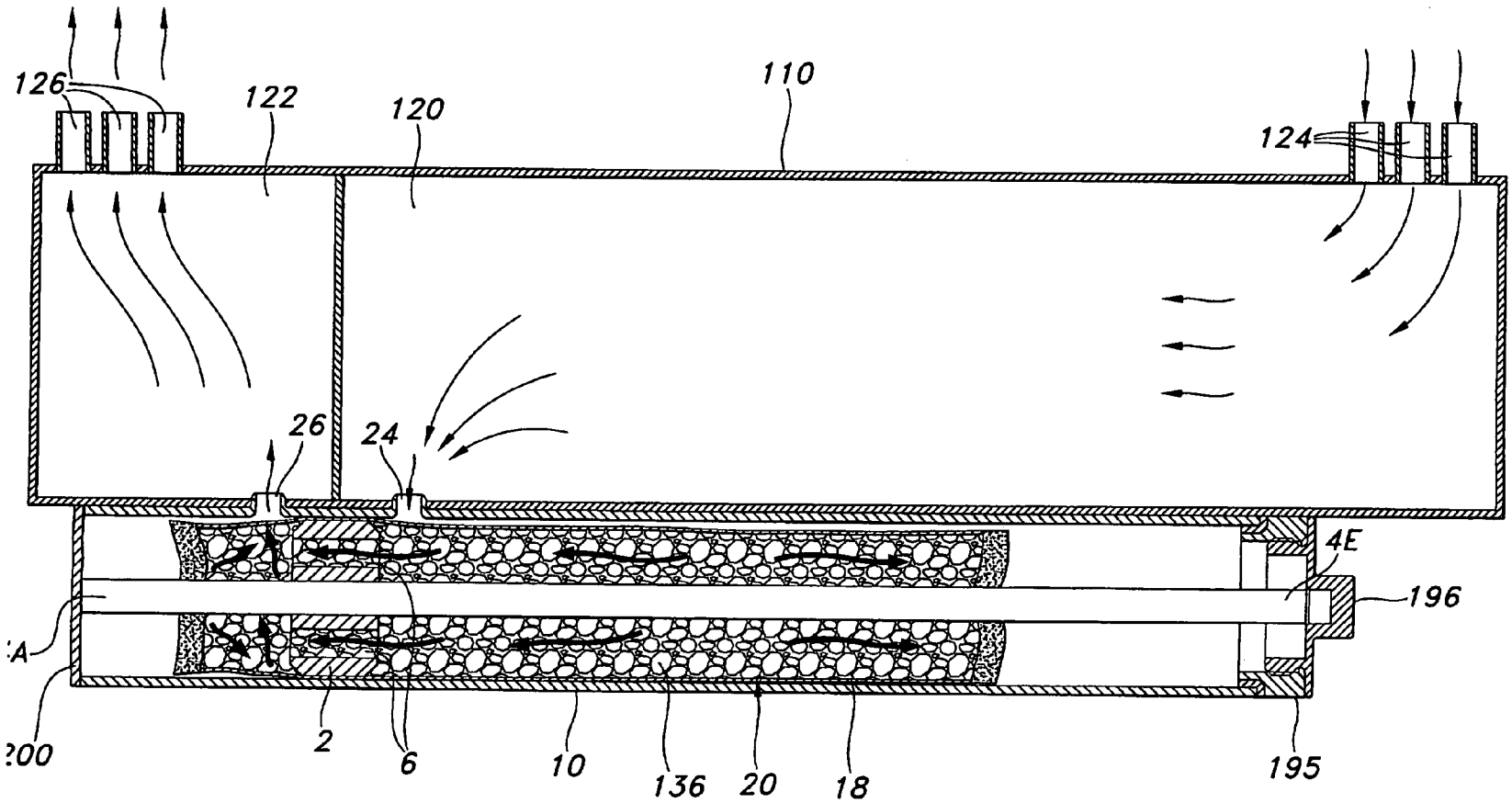
FIG. 4 is a cross section view showing a fully assembled desiccant-containing package installed in an integrated dryer chamber of an air conditioning condenser unit in accordance with yet another embodiment of the invention.

Turning now to FIG. 4, there is shown a fully assembled desiccant package 20 installed in a dryer chamber 10. Here, the dryer chamber 10 is shown juxtaposed with a header tank 110 of a condenser (not shown) for an automotive air conditioner or the like (not shown). The header tank 110 is divided into a first chamber 120 and a second chamber 122. A plurality of passages 124 communicate with the first chamber 120 while another plurality of passages 126 communicate with the second chamber 122. Those skilled in the art will recognize that the configurations of the condenser (not shown) and of the header tank 110 are not critical to the invention.

Referring again to FIG. 4, the sealing section 2 is positioned between the inlet port 24 and the outlet port 26 so as to eliminate filtration bypass. Here, the outside diameter of the sealing section plus the thickness of the desiccant bag 18 are dimensioned to provide a tight seal against an inside diameter of the chamber 10 between the inlet and outlet ports 24, 26. However, it is important to note that the seal is not too tight to inhibit the easy insertion and removal of the desiccant package 20 from the dryer chamber 10. As described above in reference to FIG. 1B, a desiccant package comprising a conical shaped base unit 9 (not shown in FIG. 4) has been found to provide more flexibility to variations in the diameters of the interior walls 25 of the chamber 10, thereby allowing a single desiccant package to be used with a variety of different size receiver chambers 10.

With continuing reference to FIG. 4, a desiccant package 20 is installed into the dryer chamber 10 by removing end plug 196, for example by twisting or pulling the end plug out of the end 195 of chamber 10. Most preferably, the plug 196 and the open end 195 of the chamber 10 present complementary threads so as to allow the plug 196 to be threadedly engaged and retained in the open end 195, although it is understood that the plug 196 and the open end 195 may present a snap or compression fit as well. The package 20 is then pressed through the open end 195 until the outlet portion 4A of the center stabilizer section lies near, or in abutment with, the end panel 200. When the package 20 is fully inserted, the package is configured in shape and size such that each side 7, 8 (see FIG. 1A) of the diameter sealing section is positioned between the inlet and outlet ports 24, 26 respectively. When so arranged, the outside diameter of the sealing section 2 engages an inner surface of the dryer chamber 10 so as to inhibit fluid from bypassing the porous desiccant package 20 between the inlet and outlet ports 24, 26. Once the desiccant package 20 is installed in the chamber 10, a plug 196 is inserted into the open end 195 of the chamber 10 to seal the open end 195. One or more annular seals (not shown) may be used to inhibit fluid flow between the plug 196 and the outer surface bounding the open end 195.

The plug 196 abuts against the elongated protruding end 4E of the stabilizer section 4 to retain the desiccant package 20 in position in the chamber 10. When so arranged, the diameter sealing section 2 and center stabilizer section 4 are configured in shape and size so as to promote correct positioning of the sealing section 2 between the inlet and outlet ports 24, 26, and inhibit lateral motion of the desiccant package 20 in the dryer chamber 10. It is important to note that in other aspects of the invention, it is contemplated that a desiccant package can be provided without a center stabilizer section whereby the base unit 9 provides the required sealing and support structure inside the receiver chamber, although the present embodiments with a stabilizer section are currently preferred. Note also that in the specific embodiment shown in FIG. 4, proximal end 4*a* and its opposite protruding end, distal end 4*e* protrude from opposite ends of the bag 18, and as shown, are positioned as stop members against respective axial ends of the chamber 10. This serves to limit axial movement of the bag 18 within the chamber. As shown, the length of proximal end 4*a* is determined by the distance of the inlet/outlet ports from the bottom of the canister. The length of the distal end 4*e* is determined by the total length of the canister and the cap design to allow for easy removal. Also, the end 4*e* may be provided with a flat spot or the like thereon to facilitate grasping by pliers or similar tools for removal during replacement. In addition, the stabilizer 4 itself need not have the rod-like cross section shown in the drawing but could also be square, triangular, etc.

In operation, refrigerant fluid (and the oil and moisture entrained therein, none shown) enters the first chamber 120 through the plurality of passages 124 and flows through the inlet port 24 into the dryer chamber 10. The fluid (not shown) within the chamber surrounds and enters the porous desiccant package 20, effectively percolating through the desiccant material 136 as best shown by the directional arrows in FIG. 4. The desiccant material 136 adsorbs oil, moisture and other contaminants from the refrigerant fluid (not shown) as the fluid percolates through the porous desiccant bag. Once inside the desiccant bag 18, the refrigerant fluid (not shown) flows from the inlet side of the bag to the outlet side of the bag through the plurality of passages 6 in the passable section of the base unit 9. Ultimately, once the fluid has reached the outlet side of the desiccant bag, the fluid flows out of the desiccant bag and through the outlet port 26 into the condenser (not shown) through the plurality of passages 126. Accordingly, the refrigerant fluid is filtered by both the inlet side and the outlet side of the desiccant package 20. Such a secondary or "double" layer of filtration provides enhanced filtration capacity over other known devices.

Moreover, the porous bag material itself, which houses the desiccant material and the internal cage component, serves as both a filter media and a sealing component between the outer diameter sealing section 2 and the inside diameter of the Integrated Condenser Dryer chamber 10. This adds yet another layer of filtration capacity, thus providing additional advantage over other known prior art devices.

The desiccant package of the present invention therefore consists of a single package that serves to properly fit the container, provide complete sealing between the inlet and outlet tubes to eliminate filtration bypass, contain the desiccant tightly, and allow for easy insertion and removal of the desiccant package from the integrated dryer chamber. The relatively simple construction permits the use of low cost materials, thereby providing cost advantage over prior art designs.

In this way, the design of the desiccant package 20 facilitates the easy removal of the desiccant package 20 from the chamber 10 when the desiccant material 136 is spent or fully saturated.

Those skilled in the art will appreciate that the only extraneous material removed from the chamber 10 when the desiccant package is removed is the internal cage component 100. Thus, since the internal cage component is relatively simple and inexpensive to produce, it is highly economic to either discard the desiccant package as a unit or to remove the internal cage component to recover the desiccant material 136 for either regeneration or separate disposal.

Although this invention has been described in conjunction with certain specific forms and modifications thereof, it will be appreciated that a wide variety of other modifications can be made without departing from the spirit and scope of the invention. For example, even though specific shapes or configurations have been shown for the sealing section 2 and fluid passages 6 in the embodiments shown, the artisan will readily appreciate that the shape and dimensions of these parts may vary based on the filtration and sealing requirements. Further, although mention has been made herein that the internal cage tube bag desiccant package herein is well adapted for use in conjunction with integrated condenser dryers, other environments for use such as semi-integrated condenser dryers can also be mentioned. For instance, if a semi-integrated unit has inlets/outlets similar to those in a fully integrated system, there is not much difference in the two systems except how it is attached to the condenser.

What is claimed is:

1. A desiccant package comprising:

a. an internal cage component having a base unit, said base unit comprising a sealing section and a passable section, said passable section having a plurality of passages passing through a length of said base unit;

b. a porous desiccant bag, said desiccant bag being configured to receive said internal cage component and a volume of desiccant material;

c. wherein said internal cage component and said desiccant material are disposed inside said desiccant bag.

2. A desiccant package as recited in claim 1 wherein said desiccant bag comprises an inside surface and wherein said sealing section presses snugly against said inside surface to form a sealing area thereat.

3. The desiccant package as recited in claim 1 wherein said length of said base unit is defined by a pair of side surfaces and wherein said passages pass. through said side surfaces to provide a plurality of passageways through said length of said base unit.

4. The desiccant package as recited in claim 1 wherein said desiccant bag is formed from a filter media material.

5. The desiccant package as recited in claim 4 wherein said internal cage component is formed from plastic or metal material.

6. The desiccant package as recited in claim 5 wherein said base unit is formed from a material selected from the group consisting of nylon, temperature resistant plastic, stainless steel, and aluminum.

7. The desiccant package as recited in claim 1 wherein said internal cage component further comprises a stabilizer section extending axially away from said base unit.

8. The desiccant package as recited in claim 7 wherein said stabilizer section protrudes beyond an end of said desiccant bag, said end of said desiccant bag being sealed around said protruding stabilizer section to prevent the escape of said desiccant material.

9. The desiccant package as recited in claim 7 wherein said stabilizer section protrudes beyond both ends of said desiccant bag, said both ends of said desiccant bag being sealed around said protruding stabilizer section to prevent the escape of said desiccant material.

10. A method for installing a desiccant package into a chamber of an integral receiver dryer, said method comprising the steps of:

a. providing an internal cage component having a base unit, said base unit comprising a sealing section and a passable section, said passable section having a plurality of passages passing through a length of said base unit;

b. providing a porous desiccant bag to receive said internal cage component and a volume of desiccant material;

c. enclosing said internal cage component and said desiccant material inside said desiccant bag, wherein said sealing section presses snugly against an inside surface of said desiccant bag to form a sealing area thereat;

d. installing said desiccant package through an open end of said chamber, wherein said sealing area is effective to provide a tight seal against an inner diameter of said chamber, said internal cage component being configured to position said sealing area between an inlet port and an outlet port of said chamber.

11. The method as recited in claim 10 wherein said desiccant bag is formed from a filter media material.

12. The method as recited in claim 11 wherein said internal cage component is formed from plastic or metal material.

13. The method as recited in claim 12 wherein said base unit is formed from a material selected from the group consisting of nylon, temperature resistant plastic, stainless steel, and aluminum.

14. The method as recited in claim 10 wherein said dryer comprises a tube having a fluid inlet port and a fluid outlet port and wherein said installing d) further includes placing said sealing area between said fluid inlet port and said fluid outlet port to provide a seal thereat.

15. The method as recited in claim 10 wherein said internal cage component further comprises a stabilizer section extending axially away from said base unit.

16. The method as recited in claim 15 wherein said stabilizer section protrudes beyond an end of said desiccant bag, said end of said desiccant bag being sealed around said stabilizer section to prevent the escape of said desiccant material.

17. The method as recited in claim 15 wherein said stabilizer section protrudes beyond both ends of said desiccant bag, said both ends of said desiccant bag being sealed around said stabilizer section to prevent the escape of said desiccant material, said stabilizer having a proximal end and a distal end, wherein the lengths of said ends are adapted to about respective ends of said chamber.

* * * * *